United States Patent [19]

Mitchell

[11] 4,179,033

[45] Dec. 18, 1979

[54] MODULAR RACK FOR DISPLAYING MERCHANDISE

[76] Inventor: Patrick J. Mitchell, 836 Industry Dr., Tukwila, Wash. 98188

[21] Appl. No.: 881,419

[22] Filed: Feb. 27, 1978

Related U.S. Application Data

[63] Continuation of Ser. No. 757,367, Jan. 6, 1977, abandoned.

[51] Int. Cl.[2] ..... A47F 7/17

[52] U.S. Cl. ..... 211/60 R; 211/45; 211/189

[58] Field of Search ..... 211/189, 194, 74, 71, 211/84, 126, 60 R, 60 G, 133, 128, 49 R, 45; 312/111, 108, 140; 40/445, 489, 606; 248/68 CB

[56] References Cited

U.S. PATENT DOCUMENTS

| | | | |
|---|---|---|---|
| 449,734 | 4/1891 | Eastman | 312/287 X |
| 2,545,171 | 3/1951 | Schroeder | 211/60 R |
| 2,992,012 | 7/1961 | Herold | 211/60 G X |
| 3,164,185 | 1/1965 | Ingoldt | 211/60 G X |
| 3,287,075 | 11/1966 | Batke et al. | 312/108 |
| 3,529,730 | 9/1970 | Thompson | 211/84 X |
| 3,552,579 | 1/1971 | Simon et al. | 211/126 |
| 3,746,178 | 7/1973 | Wagschal | 211/194 X |
| 3,757,934 | 9/1973 | Taub | 40/124.1 X |
| 3,986,756 | 10/1976 | Kranich | 312/117 |

FOREIGN PATENT DOCUMENTS

| | | | |
|---|---|---|---|
| 550178 | 10/1956 | Italy | 248/68 CB |
| 947357 | 1/1964 | United Kingdom | 40/606 |

*Primary Examiner*—Rodney H. Bonck

*Attorney, Agent, or Firm*—Seed, Berry, Vernon & Baynham

[57] ABSTRACT

A modular rack is formed of two identical end members each with three vertically spaced openings. The end members are interconnected by tubular storage compartments which fit within each of the openings. A rectangular display card is fitted into a vertical slot laterally adjacent each of the end openings in at least one of the end members with the display card being adapted to carry a sample of the merchandise within the adjacent compartment. Additional rack units can be stacked on top of one another or can be connected together in endwise adjacency. When racks are connected in endwise adjacency the vertical slots of the two abutting end members can be coaligned so that a splicing board can be interfitted into the slots to lock the abutting end members together.

9 Claims, 8 Drawing Figures

FIG. 1
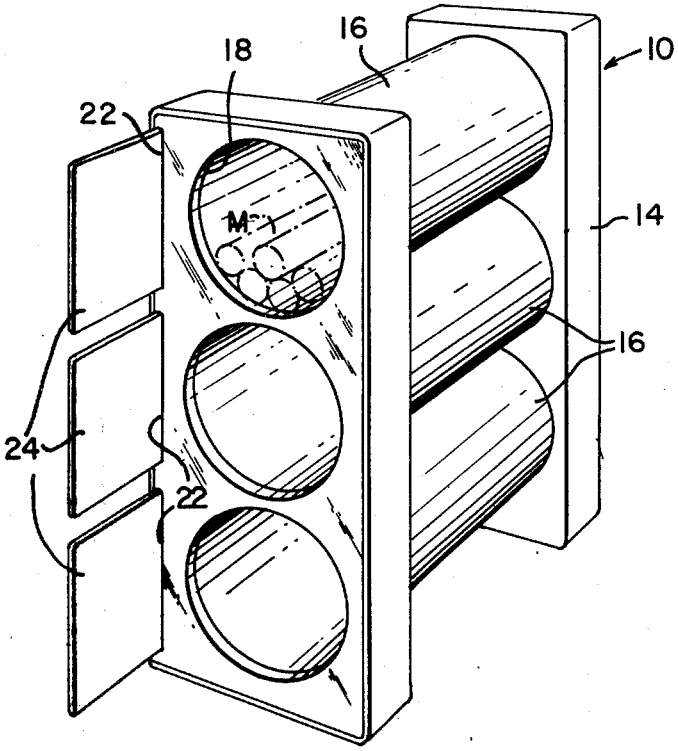
FIG. 2
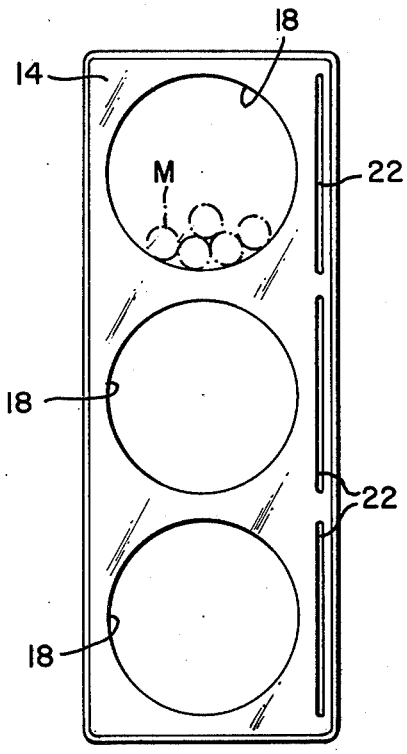
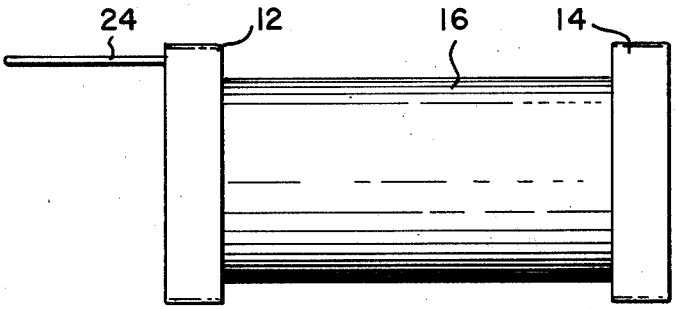
FIG. 4
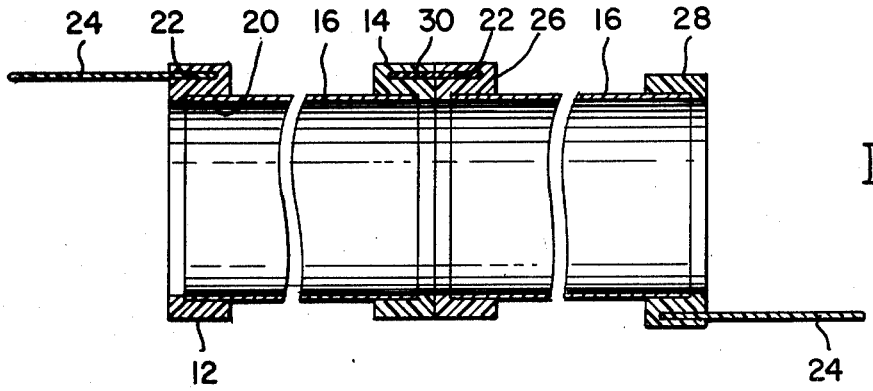
FIG. 3

MODULAR RACK FOR DISPLAYING MERCHANDISE

This is a continuation of application Ser. No. 757,367, filed Jan. 6, 1977, and now abandoned.

BACKGROUND OF THE INVENTION

1. Field of the Invention

This invention pertains to display racks for merchandise, particularly, fabric or paper goods merchandise such as rolls of wallpaper where it is desirable to place a sample of the merchandise close to its storage compartment.

2. Description of the Prior Art

The merchandising of fabrics and wallpaper, particularly wallpaper, has generally occurred by giving the customer access to several sample books and then having the customer obtain the wallpaper from the factory or a regional distribution center upon order. Mistakes made by the distribution center and the delay in obtaining the wallpaper has made this type of merchandising technique inconvenient and unsatisfactory for the customer. The modern trend is to now have a more limited selection of wallpaper available at the retail outlet so that the customer can select from a sample and take the wallpaper home at the same time. Heretofore, a convenient and sales appealing display rack for holding the merchandise, such as wallpaper, has not been available.

In general, the standard merchandising display rack used for the above purpose is a specially made carpenter erected wooden display rack which is aesthetically unappealing and expensive to construct.

SUMMARY OF THE INVENTION

It is an object of this invention to provide an inexpensive modular display rack the components of which are modular units so that the components can be mass produced to provide an inexpensive but attractive display rack.

It is another object of this invention to provide a display rack suitable for storing merchandise, especially rolls of wallpaper, and to provide a display panel for displaying a sample of the wallpaper.

It is another object of this invention to provide a modular display rack for merchandise which can be easily rearranged for various displaying space requirements.

Basically these objects are obtained by providing a pair of end members each having one or more openings, preferably three openings, and being spaced therefrom. The end members are interconnected at their openings with tubular means which form merchandise storage receptacles. Preferably, again, three of these tubular means are provided. The end member facing outwardly in the direction of the customer is provided with protruding display panels laterally adjacent each of the openings so that a sample of the merchandise in the storage receptacle can be displayed. The end members are all identical units so that display panels can be protruding from opposite ends of the combined display unit or can be used to interconnect endwise a second display unit.

In the embodiment where two units each comprising two end members and two sets of tubular means are connected together the abutting end members can have their vertical slots coaligned so that a splicing board can be inserted into each to positively join the end members together. Likewise the opposite most remote end members can have their vertical slots reversed to one another so that a customer approaching from one end of the combined unit will face a display panel when travelling right to left and will also face a display panel at the opposite end member when travelling also from right to left. Since the end members are all modular, that is, identical they can be rotated end for end as desired depending on the direction in which the display panels are to face. The modular construction of the end units also provides for reduced per unit manufacturing costs and simplicity of construction. The display units can be stacked one on top of another and/or arranged side by side, and/or arranged end for end as described.

BRIEF DESCRIPTION OF THE FIGURES OF THE DRAWING

FIG. 1 is a front isometric of a modular display unit embodying the principles of the invention.

FIG. 2 is a rear elevation of the display unit shown in FIG. 1.

FIG. 3 is a horizontal section of a combined display unit of the type shown in FIG. 5.

FIG. 4 is a top plan of the display unit shown in FIG. 1.

DESCRIPTION OF THE PREFERRED EMBODIMENTS

Figure 5:
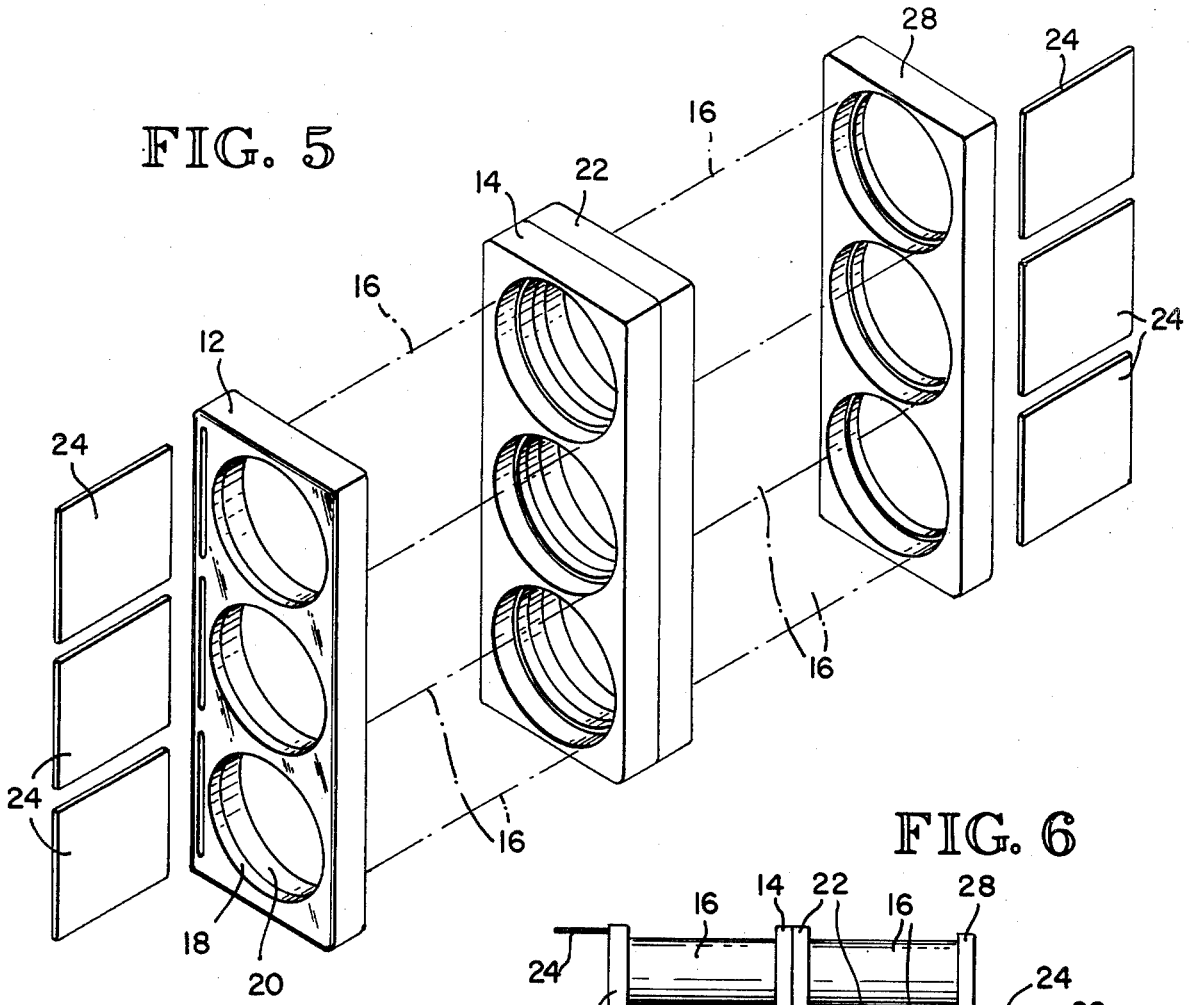
FIG. 5 is a set of display units adjoined endwise in abutting relationship.

As best illustrated in FIGS. 1–4 a modular display unit 10 is formed of modular end members 12 and 14 and modular tubes 16. The term "modular" as used herein means that the members are each identical to the same type of members. Each end member 12 and 14 includes a plurality of openings 18 which receive the ends of the tubes 16. Preferably the openings 18 have enlarged diameters as at 20 so that the inside surface of the tube 16 is flush with the inside surface of the opening 18 at its outer end.

Each of the end members is also provided with a plurality of vertical slots 22 which hold removable display panels 24. As best shown in FIG. 1, the display panel will have a swatch or sample of the merchandise M such as rolls of wallpaper.

Figure 6:
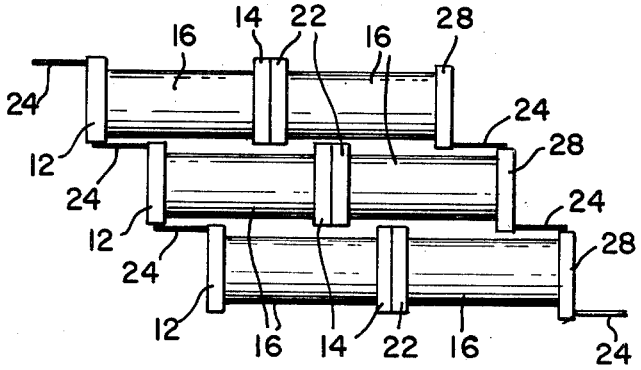
FIG. 6 illustrates a plan of the combined display units shown in FIG. 5 also arranged in side by side adjacency with other endwise connected display units.

While the advantages of the modular end panels is best achieved by being identical, it should be understood that substantial benefits are also obtained by having only the end members which are intended to be viewed by the customer provided with the vertical slots and with the opposite end members devoid of slots. Preferably, however, two endwise adjacent panels such as shown in FIGS. 3, 5 and 6 can be joined endwise together through the use of the vertical slots. As best shown in FIG. 3, for example, a second display unit having end members 26 and 28 joined by tubes 16 can have the two end members 14 and 22 in abutting relationship with the slots 22 of each being coaligned. In this manner a splicing board or plate 30 can be partially inserted into the confronting slots to splice the two end panels together. Preferably, the end panel 28 is rotated end for end relative to the end panel 12 so that its slots 22 and display panels 24 are diagonally opposite from the display panels of the end member 22. In this way the combined display units can be arranged as the center aisle in a showroom so that a customer can walk from right to left completely around both ends of the display unit and always have the display panels appearing in front of them.

In the embodiment illustrated in FIG. 6 the endwise connected panel units as shown in FIG. 5 are arranged in a staggered sidewise adjacent array.

Figure 7:
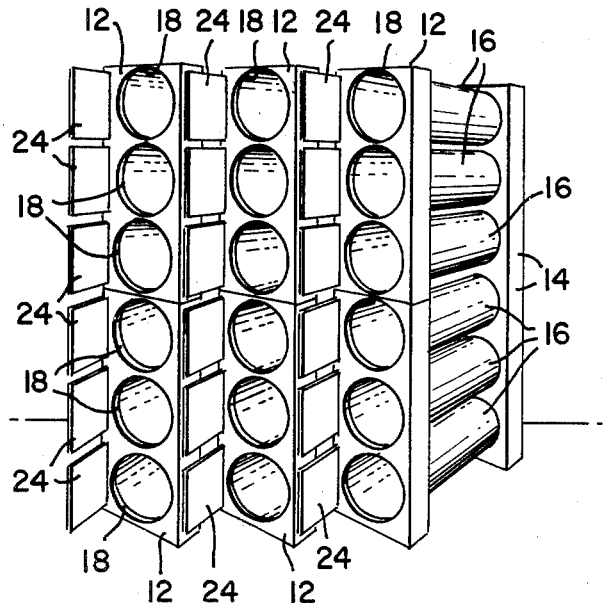
FIG. 7 is an isometric of several display units of the type shown in FIG. 1 in side by side and staggered adjacency.
Figure 8:
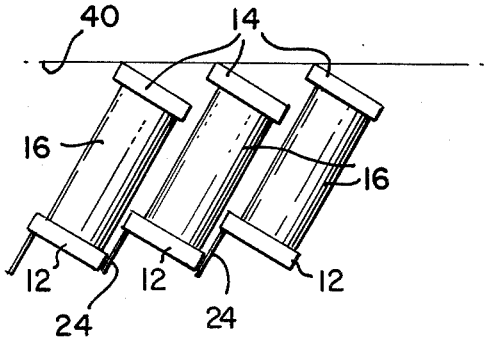
FIG. 8 is a plan view of the units shown in FIG. 7.

In the embodiments shown in FIGS. 7 and 8 single panel units arranged in vertically stacked adjacent staggered sets are illustrated. These vertically adjacent staggered sets are generally arranged along a showroom wall 40 as best shown in FIG. 8.

While the preferred embodiments of the invention have been illustrated and described it should be understood that variations will be apparent to one skilled in the art without departing from the principles herein. Accordingly, the invention is not to be limited to the specific embodiments illustrated.

The embodiments of the invention in which a particular property or privilege is claimed are:

1. A display rack for holding cylindrical objects such as rolls of wall coverings and displaying samples of the objects in a store showroom comprising:

multiple upright freestanding, lightweight, individual, freely movable tube support means, each having at least one circular opening whose axis is in a horizontal plane, and positioned adjacent one another to form a multiple, rack assembly, separate, independent horizontal circular tube means fitted in said tube support means so as to form a horizontal object supply storage compartment having a lower object supporting surface lying lengthwise of said tube means for receiving said cylindrical objects, and display means external to and operatively associated with each storage compartment visible to the passing customer and adjacent an end of each storage compartment whereby samples of the objects being stored in each tube means can be conveniently displayed adjacent the end of the respective storage compartment.

2. The display rack of claim 1 said tube support means being end members, said circular openings in said end members passing completely through the end members and including a counterbore in each end member coaxial with said circular openings and having a diameter approximately equal to the outside diameter of said circular tube means so that the tube means is held tightly within the counterbore and wherein the inside diameter of the tube means is equal to the diameter of said openings so that the surfaces of the tube means is flush with the surface of the opening.

3. The display rack of claim 1, said tube support means being end members, said display means protruding outwardly of at least one end member.

4. The display rack of claim 3, at least one of said end members having vertical slots sidewise adjacent to each opening, said display means including a separate display card inserted partially into each said slot and extending outwardly along a plane parallel to the axis of said tube means.

5. The display rack of claim 3, including third and fourth end members identical to said first and second end members, the second and third members abutting one another with said openings coaligned, second tube means interconnecting the openings of the third and fourth end members, means splicing the abutting end members together, and including second display means protruding from said fourth end member.

6. The display rack of claim 5, each said end member having a vertical slot aligned laterally adjacent an end opening, said splicing means including a board partially inserted into coaligned slots of the abutting second and third end members.

7. The rack of claim 6, each opening of each end member being offset laterally from the center of the end member toward the side of the end member opposite the vertical slot, the fourth end member being rotated 180 degrees to have its vertical slot lying on the opposite side of the center of the tube means from the vertical slot of the first end member.

8. The display rack of claim 3, said tube support means being aligned side-by-side and each inclined relative to a vertical plane to provide a staggered array of adjacent tube support means each with a protruding display means.

9. The display rack of claim 3, each end member including three vertically spaced said openings, and tube means interconnecting each of the openings.

* * * * *